United States Patent [19]

Klein et al.

[11] 4,156,121

[45] May 22, 1979

[54] MOLDED BREAKER CASE HOUSING MOLDED CASE CIRCUIT BREAKER

[75] Inventors: Keith W. Klein, Simsbury; Morris J. Kornblit, Newington; Joseph M. Palmieri, Southington, all of Conn.

[73] Assignee: General Electric Company, New York, N.Y.

[21] Appl. No.: 802,620

[22] Filed: Jun. 2, 1977

[51] Int. Cl.[2] ..... H01H 1/58; H01H 9/02

[52] U.S. Cl. ..... 200/293

[58] Field of Search ..... 200/293, 302, 303, 297; 335/18; 361/353, 354, 363, 357, 376

[56] References Cited

U.S. PATENT DOCUMENTS

| | | | |
|---|---|---|---|
| 2,065,356 | 12/1936 | Von Hoorn | 200/297 X |
| 2,273,729 | 2/1942 | Tornblom | 200/303 |
| 2,567,962 | 9/1951 | O'Brien et al. | 200/298 X |
| 3,098,141 | 7/1963 | Wintress | 200/302 X |
| 3,171,007 | 2/1965 | Zavertnik | 200/303 X |
| 3,204,150 | 8/1965 | Gauthier | 361/376 |
| 3,215,807 | 11/1965 | Spitler | 200/302 X |
| 3,312,794 | 4/1967 | Hollyday | 200/42 T |
| 3,852,514 | 12/1974 | Lauben | 361/357 X |
| 3,950,677 | 4/1976 | Klein et al. | 361/376 |

*Primary Examiner*—Herbert F. Ross

*Attorney, Agent, or Firm*—Robert A. Cahill; Walter C. Bernkopf; Philip L. Schlamp

[57] ABSTRACT

A molded circuit breaker case complete with line and load terminals is fashioned to house a molded case circuit breaker. Rigid conductive straps affixed to the outer case provide electrical connections between the case line and load terminals and the circuit breaker line and load terminals, respectively, and, in addition, serve to secure the circuit breaker in place. The circuit breaker operating handle protrudes through an opening in the outer case to facilitate manual circuit breaker operation.

2 Claims, 4 Drawing Figures

MOLDED BREAKER CASE HOUSING MOLDED CASE CIRCUIT BREAKER

BACKGROUND OF THE INVENTION

With the advancement in the state of the art, modern molded case circuit breakers have become more compact and yet provide current ratings and interrupting capacities comparable to their bulky ancestors for most applications. In addition, modern circuit breakers afford considerable economics in materials and manufacturing costs. Yet there remains significant demand for these bulky, old style circuit breakers, mainly as replacement molded case breakers for service entry equipment installed years ago. Naturally, there is an extreme reluctance on the part of any manufacturer to discontinue production of components needed only as replacements by past customers of old style equipment which remains serviceable. To do so would likely alienate these old customers and could well jeopardize future sales. Yet, to maintain manufacturing facilities for both the old style and new style equipment is extremely expensive, and, to exacerbate the situation, the manufacturer typically can not charge a price for the old style equipment sufficient to recover full costs. Thus, maintaining the availability of old style equipment is normally an unprofitable enterprise which is endured as a service to accommodate past customers.

In recent years, circuit breaker manufacturers have been marketing protective devices which provide not only the traditional overload and short circuit protection, but also ground fault protections. Such devices, termed ground fault circuit interrupting (GFCI) devices, are currently being offered in a compact circuit breaker configuration for installation in modern service entry equipment as a direct substitute for the compact, new style molded case circuit breakers affording only traditional circuit protection, i.e., overload and short circuit protection. Unfortunately users of the old style service entry equipment can not avail themselves of the additional ground fault protection afforded by GFCI circuit breakers, simply because these modern GFCI devices are not readily accommodatable in their equipment, both from physical and electrical standpoints.

It is accordingly an object of the present invention to provide a circuit breaker assembly having the physical size of an old style breaker and the manufacturing economies of a new style breaker.

An additional object is to provide a circuit breaker assembly of the above-character offering the full measure of modern day circuit protection and yet can be conveniently retrofitted in old style service entry equipment.

A further object is to provide a circuit breaker assembly of the above character which is convenient to assemble, inexpensive to manufacture and reliable in operation.

Other objects of the invention will in part be obvious and in part appear hereinafter.

SUMMARY OF THE INVENTION

In accordance with the present invention, there is provided a circuit breaker assembly wherein a conventional, compact, operational molded case circuit breaker is housed in a molded breaker case having the physical size and configuration such as to render the assembly capable of installation in service entry equipment, such as load centers and panelboards, which is not otherwise compatible with the compact molded case circuit breaker. The outer case is completely devoid of circuit breaker parts and thus provides an internal cavity in which the compact circuit breaker is nested. The case is however equipped with line and load terminal connectors, as well as the requisite mount features for physical and electrical installation in the service entry equipment. Rigid line and load straps, affixed to the outer case, serve to electrically connect these line and load terminal connectors respectively to the line and load terminals of the compact circuit breaker and also function to secure the position of the compact circuit breaker within the outer case. The operating handle of the circuit breaker protrudes through an opening in the outer case for convenient manual operation.

In the illustrated embodiment of the present invention, the operational circuit breaker is a GFCI circuit breaker having ground fault protection capability, as well as overload and short circuit protection capabilities. The opening in the outer case through which the breaker operating handle protrudes also exposes the test pushbutton normally provided with GFCI devices to check its operability. The case is also provided with a secondary opening through which extend a pair of wires leading from the encased GFCI circuit breaker for connection with the panelboard neutral bar and the neutral side of the load circuit.

The invention accordingly comprises the features of construction, combination of elements and arrangement of parts which will be exemplified in the construction hereinafter set forth, and the scope of the invention will be indicated in the claims.

For a fuller understanding of the nature and objects of the present invention, reference should be had to the following detailed description taken in conjunction with the accompanying drawings, in which.

Corresponding reference numerals refer to like parts throughout the several views of the drawings.

DETAILED DESCRIPTION

Figure 1:
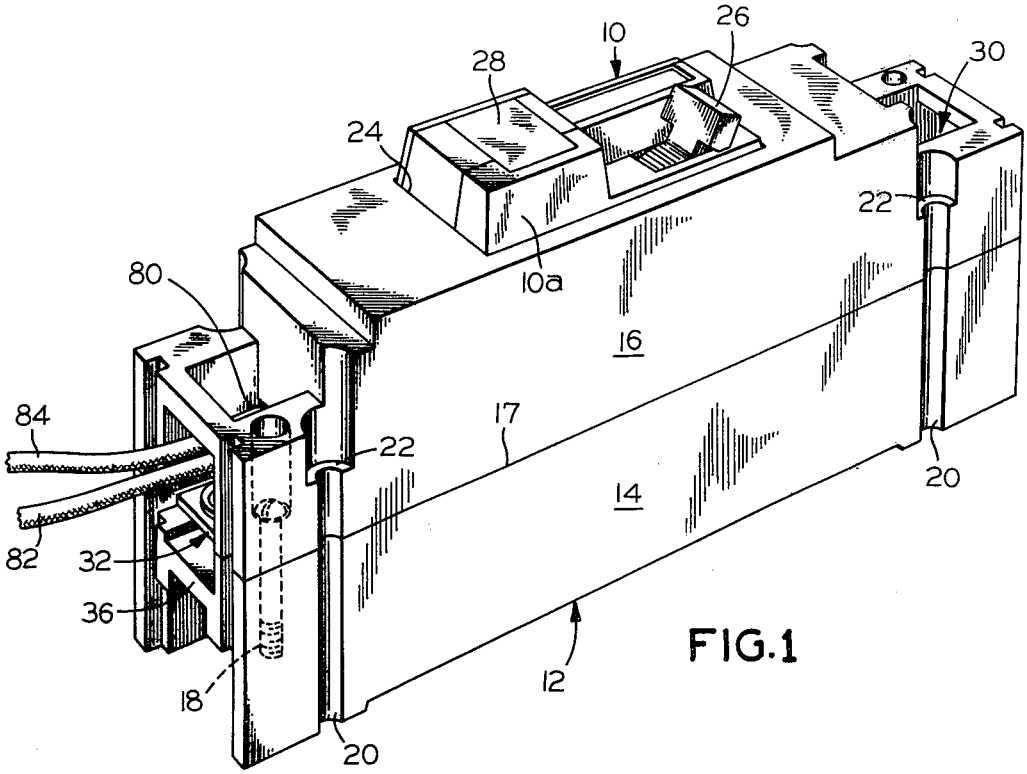
FIG. 1 is a perspective view of a circuit breaker assembly having an operational, compact circuit breaker housed within a molded circuit breaker case in accordance with the present invention.
Figure 2:
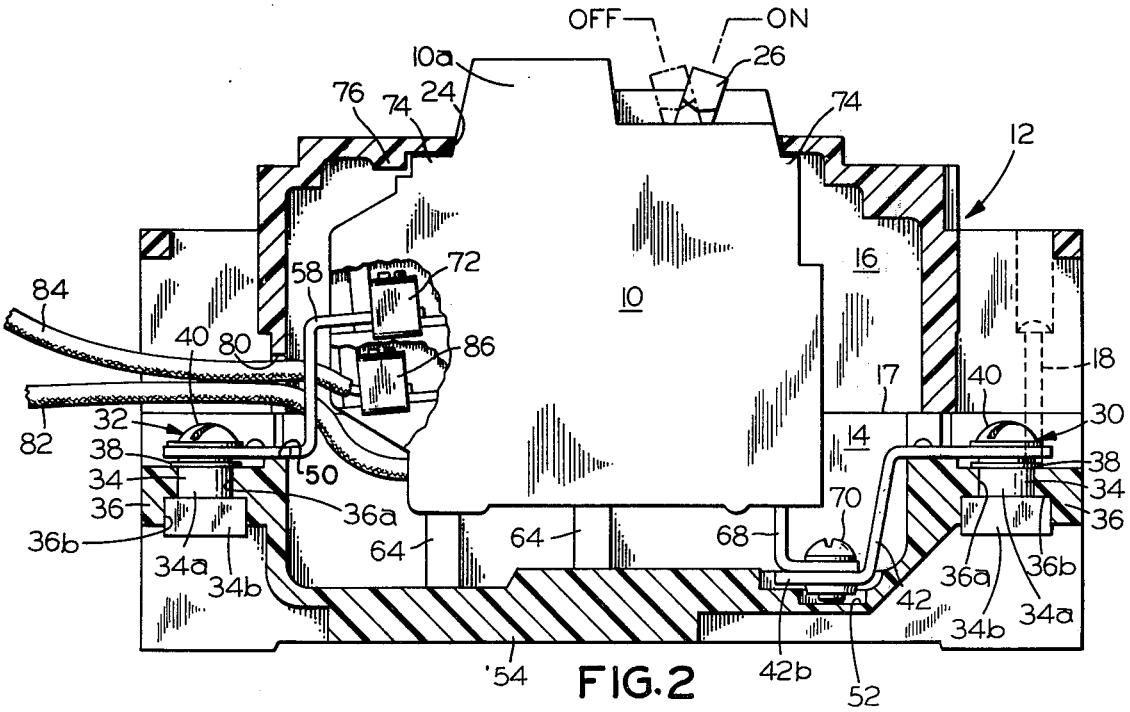
FIG. 2 is a longitudinal sectional view, partially broken away, of the circuit breaker assembly of FIG. 1.
Figure 3:
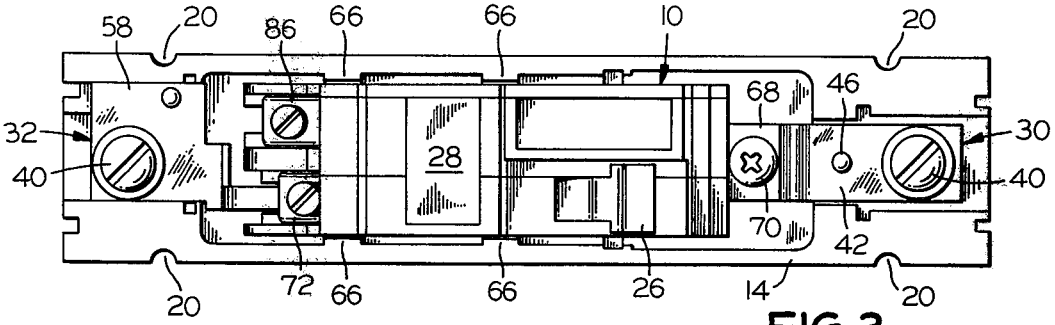
FIG. 3 is a plan view of the circuit breaker assembly of FIG. 1 with the cover of the outer circuit breaker case removed.

Referring now to the drawings, the circuit breaker assembly, as seen in FIGS. 1 through 3, comprises a compact, residential type circuit breaker; generally indicated at 10, which is housed with a circuit breaker case, generally indicated at 12. For purposes of illustration, circuit breaker 10 is shown as a Q line GFCI circuit breaker currently being offered by the Circuit Protective Devices Department of the General Electric Company, assignee of the instant application. Outer case 12, again for purposes of illustration, is shown as having the overall dimensions and configuration of the molded case normally housing the circuit breaker parts of a single pole E line breaker also marketed by the General Electric Company. The outer case consists of a lower base 14 and an upper cover 16 meeting along a perimetrical seam 17 to define an internal cavity in which circuit breaker 10 is nested. The base and cover are united by screws, seen in phantom at 18 in FIGS. 1 and 2. Surface grooves 20 in the case sidewalls are countergrooved to provide shoulders 22 which are engaged by the heads of elongated screws (not shown) pursuant to mounting the circuit breaker assembly of the invention in panelboards which are not designed to accept the compact circuit breaker 10. The top surface of cover 16 is provided with an opening 24 through which the upper escutcheon portion 10*a* of the molded case for circuit breaker 10 protrudes. An operating handle 26 protruding through an opening in escutcheon portion 10*a* is readily accessible for manual operation of circuit breaker 10. Also included in escutcheon portion 10*a* is a pushbutton 28 which is also accessible for manual depression to periodically test the ground fault interrupting operability of circuit breaker 10.

The outer case is equipped with line and load terminals 30 and 32, respectively, externally accessible at opposed ends thereof. Each terminal, as best seen in FIG. 2, includes a post 34 having a cylindrical body 34*a* and a rectangular base 34*b* which is inserted from below through a bore 36*a* formed in a horizontal ledge 36 provided in base 14 of the outer case. The underside of ledge 36 is routed out to provide a rectangular recess 36*b* for receipt of post base 34*b* for anti-turn purposes. The upper end portion of post body 34*a* is provided with an annular groove located just above ledge 36 for receipt of a spring clip 38 pursuant to locking the terminal post in place. A binding head screw 40 is threaded into a tapped central bore in post 34 of each of the line and load terminals 30, 32.

Figure 4:
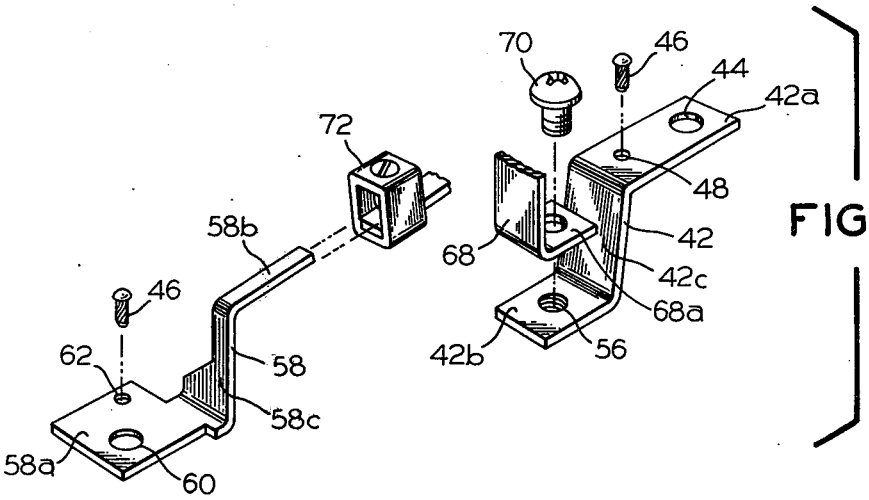
FIG. 4 is a fragmentary perspective view of the electrical interconnections between the outer case terminals and the encased circuit breaker terminals.

Referring to FIGS. 2 through 4, a line terminal connector strap 42, somewhat of an S-shaped configuration, includes a laterally bent, outward extending upper portion 42*a* and a laterally bent, inwardly extending lower portion 42*b* integrally joined by body portion 42*c*. The upper strap portion is provided with a hole 44 (FIG. 4) accommodating the shank of binding head screw 40 threaded into terminal post 34 of the outer case line terminal 30. A push pin 46 passing through a hole 48 in upper strap portion 42*a* is force-fitted in a bore (not shown) formed in a shoulder 50 (FIG. 2) provided in base 14 just inwardly of ledge 36 to hold the connector strap in place while binding head screw 40 is loose. The strap body portion angles downwardly to disposed lower portion 42*b* in a recess 52 formed in the floor 54 of base 14. A tapped hole 56 is formed in this lower strap portion.

A second, somewhat S-shaped terminal connector strap 58 is provided with a laterally bent, outward extending lower portion 58*a* and a laterally bent, inwardly extending upper tang portion 58*b* of reduced width integrally joined by a body portion 58*c*. The lower portion 58*a* is formed with a hole 60 through which the shank of binding screw 40 extends as it is threaded into terminal post 34 of the outer case load terminal 32. A push pin 46 is inserted through another hole 62 in lower strap portion 58*a* and force-fitted into a bore (not shown) in ledge 36 to hold the strap 58 in place while binding head screw 40 is loosened.

To provide underlying support for circuit breaker 10 within outer case 12, a pair of upstanding pads 64 (FIG. 2) are integrally molded in the interior bottom surface of base 14. As seen in FIG. 3, vertical ribs 66 molded in the sidewalls of base 14 serve to locate and afford a measure of lateral stability for the lower portion of circuit breaker 10 accommodated in the base. With the circuit breaker positioned in base 14, a line terminal strap 68 depending from the lower right corner of the breaker case has a laterally turned, apertured foot portion 68*a* which is clamped in electrical connection with the lower terminal connector strap portion 42*b* by a screw 70 threaded into hole 56. The upper tang portion 58*b* is clamped in a wire lug 72 included with the load power terminal of circuit breaker 10 to electrically connect this circuit breaker terminal to the outer case load terminal 32. It will be appreciated that the inherent rigidity of the line and load terminal connector straps serves to hold circuit breaker 10 in position. Moreover, when the binding head screws 40 are tightened to clamp external wires in electrical connection with the outer case line and load terminals 30,32, the terminal connector straps become solidly anchored to the outer case, and the nested position of the circuit breaker is thus rendered more secure.

From FIG. 2 it is seen that, with cover 16 united with base 14, portions of the cover adjacent opening 24 overlie shoulders 74 provided on the molded case of the circuit breaker. An internal, depending rib 76 molded in cover 16 is located in contiguous relation to the vertical edge of one of the shoulders 74. The portion of cover 16 comprising the perimeter of opening 24 is in close fitting relation with the escutcheon portion 10*a* of the circuit breaker case. All of these structural features incorporated in cover 16 serve to stabilize the upper portion of circuit breaker 10 when the base and cover are united to form outer case 12.

When circuit breaker 10 is in the form of a conventional circuit protective device affording overload and short circuit protection, electrical installation of the circuit breaker assembly of the present invention is effected by electrically connecting a wire (not shown) from the line side of a source to line terminal 30 and electrically connecting a wire (not shown) from one side of a load to load terminal 32. The neutral side of the source and the load return wire are electrically connected in common within a panelboard via a neutral bar (not shown), as is conventional. On the other hand, if, as illustrated in the drawings, circuit breaker 10 is a GFCI circuit breaker, the assembly of the present invention further includes a pair of wires which are brought out from the interior of outer case 12 through a slot 80 (FIG. 2) formed in cover 16 immediately above the load terminal 32 carried by base 14. One of these wires, wire 82, emanates from the interior of circuit breaker 10 and, for electrical installation of the assembly, is connected to the panelboard neutral bar. The other of these wires, wire 84, is electrically connected at its termination within outer case 12 to a wire lug 86 associated with the load neutral terminal of circuit breaker 10. The other end of wire 84 is for electrical connection via, for example, a wire nut to the load return or neutral wire. In this way, circuit breaker 10 can monitor the currents flowing in both sides of the load circuit pursuant to sensing any current imbalances occasioned by the existence of ground leakage current.

While the circuit breaker assembly of the invention is disclosed as a single pole device, it will be appreciated that the outer case can be widened to accommodate in modular fashion plural compact circuit breakers in side-by-side relation to provide a multipole device; the plural circuit breakers preferably being operationally interconnected in conventional fashion via a handle tie and an internal common trip bar.

It will thus be seen that the objects set forth above, among these made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A circuit breaker assembly comprising, in combination:

A. an operational molded case circuit breaker incldding line and load terminals and an operating handle;

B. an outer molded circuit breaker case including a base and a cover, which, upon being united, define an internal cavity in which said circuit breaker is nested;

C. aligned means provided in said base and said cover facilitating mounting of said outer case in a circuit breaker panelboard;

D. an external line terminal post secured in said base and being manually accessible with said base and cover united;

E. an external load terminal post secured in said base and being manually accessible with said base and cover united;

F. a rigid line strap having an outer end clamped in said external line terminal post;

G. a rigid load strap having an outer end clamped in said external load terminal connector;

H. separate electrical connectors rigidly clamping the inner ends of said line and load straps respectively to said circuit breaker line and load terminals, whereby said line and load straps maintain said circuit breaker secured in said base upon removal of said cover; and I. means forming an opening in said outer case through which said circuit breaker operating handle protrudes when said cover is united with said case.

2. The circuit breaker assembly defined in claim 1, wherein said circuit breaker is a GFCI circuit breaker having a line terminal, a load power terminal, a load neutral terminal, and a panel neutral connector wire emanating from its molded case, said line strap electrically interconnecting said circuit breaker line terminal and said external lie terminal post, said load strap electrically interconnecting said circuit breaker load power terminal and said external load terminal post, (1) a load neutral connector wire electrically connected to said load neutral terminal, and (2) means forming a slot in said outer case accommodating the egress of said panel neutral and load neutral connector wires from said internal cavity.

* * * * *